US006055001A

United States Patent [19]

Sakaki et al.

[11] Patent Number: 6,055,001

[45] Date of Patent: Apr. 25, 2000

[54] RECORDING METHOD BASED ON DIRECTION OF CUT OF RECORDING SHEETS AND APPARATUS THEREFOR

[75] Inventors: Mamoru Sakaki, Sagamihara; Yutaka Kurabayashi, Yokohama, both of Japan

[73] Assignee: Canon Kabushiki Kaisha, Tokyo, Japan

[21] Appl. No.: 08/358,990

[22] Filed: Dec. 19, 1994

Related U.S. Application Data

[63] Continuation of application No. 07/942,225, Sep. 9, 1992, abandoned.

[30] Foreign Application Priority Data

Sep. 13, 1991 [JP] Japan ..... 3-234716

[51] Int. Cl.[7] ..... B41J 13/00

[52] U.S. Cl. ..... 346/134

[58] Field of Search ..... 346/134, 24; 83/89, 83/86; 428/192; 493/340, 328; 347/101, 104, 105, 106; 427/293, 289

[56] References Cited

U.S. PATENT DOCUMENTS

| | | | |
|---|---|---|---|
| 2,320,702 | 6/1943 | Marchese et al. | 427/293 |
| 3,146,649 | 9/1964 | Burger | 83/86 |
| 3,730,043 | 5/1973 | Zimmermann | 83/502 |
| 4,240,870 | 12/1980 | Shibazaki et al. | 162/181.2 |
| 4,313,124 | 1/1982 | Hara | 346/140 R |
| 4,440,827 | 4/1984 | Miyamoto et al. | 347/105 |

FOREIGN PATENT DOCUMENTS

| | | | |
|---|---|---|---|
| 3-169556 | 7/1991 | Japan | 347/101 |

*Primary Examiner*—N. Le
*Assistant Examiner*—Anh T. N. Vo
*Attorney, Agent, or Firm*—Fitzpatrick, Cella, Harper & Scinto

[57] ABSTRACT

A recording method according to the present invention performs recording on recording materials using a recording apparatus having a separation pad which is brought into contact with a non-recording surface of one recording material of a recording material stack during feeding of the one recording material to a recording position to separate the one recording material from the other recording materials. The recording materials are those whose four sides are cut in a direction from the non-recording surface to a recording surface.

14 Claims, 1 Drawing Sheet

RECORDING METHOD BASED ON DIRECTION OF CUT OF RECORDING SHEETS AND APPARATUS THEREFOR

This application is a continuation of application Ser. No. 07/942,225, filed Sep. 9, 1992, now abandoned.

BACKGROUND OF THE INVENTION

1. Field of the Invention

The present invention relates to a recording method suitable for recording on sheets of coated paper, as well as an apparatus therefor.

2. Description of the Related Art

In the field of recording apparatus, it is known to employ a paper feeding method including feeding means which makes contact with the recording surface of each sheet of recording paper piled on top of one another (a recording material stack) to feed the recording material to a recording portion. It is further known to employ separating means which makes contact with the rear surface of each sheet of the recording paper to prevent double feed of the recording paper during paper feeding.

FIG. 1 illustrates an example of such a recording apparatus. In FIG. 1, sheets of recording material 2 are placed on a paper feed tray 1. A semi-circular paper feed roller (feeding means) 3 is rotated in a counterclockwise direction and is thereby brought into contact with the recording surface of each of the recording material sheets 2 placed on the paper feed tray 1, by which that recording material 2 sheet is fed onto a platen 9.

A separation pad (separating means) 4 is the separation means into which is brought into contact the rear surface of the recording material 2 during the paper feeding operation, and by which a single sheet is separated from the sheets of recording paper by utilizing the friction between the pad and the rear surface of the recording material when two or more sheets are fed by feed roller 3. Consequently, a single sheet of recording material is fed to a conveying roller 5.

In the recording portion, recording is performed on the recording material 2 which has been fed thereto through the conveying roller 5 by a recording head 6. The recording material 2 on which recording has been conducted is placed onto a paper discharge tray 8 through a paper discharge roller 7.

The aforementioned conventional recording apparatus has a problem in that paper feed failures occur after a large number of sheets of recording paper are fed.

A recording method which employs inks of many colors, particularly, a full-color ink jet recording method, uses coated paper in which a coated layer containing a pigment is formed on a substrate. The coated paper exhibits excellent coloring and absorption properties of inks and offers vivid images. However, when such a recording material is used, the aforementioned paper feed failures are even more prevalent.

SUMMARY OF THE INVENTION

An object of the present invention is to provide a recording method which can eliminate paper feed failures even after recording is performed on a large amount of recording materials, and even when the recording material used is coated paper.

Another object of the present invention is to provide a recording apparatus which can eliminate paper feed failures which would occur after a large amount of normal recording paper, including the coated paper, are fed.

In one aspect of the invention there is provided a method of feeding to a recording apparatus recording materials having a recording surface and a non-recording surface, comprising providing a stack of recording materials having the recording surface facing upward and bringing a feeding means into contact with the uppermost sheet in said stack, said feeding means bringing the non-recording surface of one recording material of the recording material stack into contact with a separation means to separate the one recording material from other recording materials, wherein the recording materials are those whose four sides are cut from a direction of the non-recording surface toward the recording surface.

In another aspect of the invention there is provided a method of feeding to a recording apparatus, recording materials having a coated surface layer containing a pigment on substrate, the coated surface layer being a recording surface and the reverse side being a non-recording surface comprising providing a stack of recording materials having the recording surface facing upward and bringing a feeding means into contact with the uppermost sheet in said stack, said feeding means bringing a non-recording surface of one recording material of the recording material stack into contact with a separation means to separate the one recording material from other recording materials, where the recording materials are those whose four sides are cut from a direction of the non-recording surface toward the recording surface.

In yet another aspect of the invention there is provided a recording apparatus comprising a tray for stacking recording materials, a plurality of recording materials stacked in said tray, means for feeding recording materials from said recording material stack one by one to a recording position, said feeding means bringing one surface of the one recording material into contact with said separation means during feeding thereof to separate the one recording material from other recording materials, and a recording head for recording on the one recording material which has been fed to said recording position by said feeding means, wherein said separation means is disposed such that it makes contact with a surface of the recording material from the recording material stack which is the surface from which direction the recording material is cut.

DETAILED DESCRIPTION OF THE PREFERRED EMBODIMENTS

In order to solve the aforementioned problem, the present inventors made intensive studies on the paper feed failures which would occur when the recording material is used in the recording apparatus, and discovered that not only does the composition and properties of the recording material and the properties and composition of a coated layer in the case of a coated paper greatly effect the occurrence of paper feed failure, but that the cut surface formed when the recording material is cut also greatly affects the occurrence of the paper feed failures. More specifically, it has been discovered that the direction of cutting will greatly affect the occurrence of the paper feed failures. The present invention is based on the aforementioned knowledge. It is understood that the paper feed failures are affected by the direction of cutting because the end portions of the recording material are bent toward the direction in which the recording material is cut, that is, because burr or chips are generated on the sides of the recording material toward which the recording material is cut. Therefore, in the case of a recording material which is cut from the recording surface side (in the case of a coated paper, from the surface on which the coated layer is formed) to the back surface thereof, fine chips, such as burrs or paper nap, are generated on the sides of the rear surface of the recording material. Also, the cut portion of the recording material is curved toward the rear surface thereof. When viewed from the side of the rear surface, such a recording material looks with the four sides thereof curved toward this side thereof.

In the recording operation performed on a large amount of such recording material, the separation means which rubs the rear surface of the recording material during paper feeding is worn by the end portion of the recording material which is curved toward the separation means, and the frictional force between the separation means and the rear surface of the recording material thus increases.

Particularly, when the coated paper is used for recording, not only the aforementioned drawback occurs but also the paper feed means is brought into direct contact with the coated surface and thereby receives paper powder from the coated layer. Consequently, the frictional force between the paper feed means and the recording material gradually reduces.

How the paper feed failure occurs from the above-described reasons will be explained below.

Figure 1:
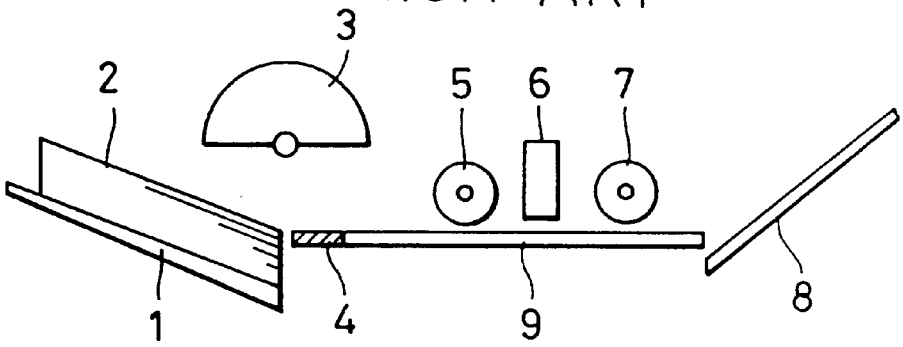
FIG. 1 PRIOR ART
FIG. 1 illustrates the concept of a recording apparatus used to carry out a recording method according to the present invention and FIGS. 2(*a*) and 2(*b*) schematically illustrate an example of a recording material used in the present invention.

In the structure shown in FIG. 1, the plurality of recording materials (recording material stack) placed on the paper feed tray 1 are conveyed in sequence toward the separation pad 4 by the paper feed roller 3. Now, the case in which two sheets of recording materials are simultaneously conveyed between the paper feed roller 3 and the separation pad 4 in such a manner that they are stacked on top of another will be considered.

The recording material are fed in a normal state one by one under the condition expressed by:

$$\mu 1 > \mu 3 > \mu 2$$

where $\mu 1$ is the frictional force between the roller 3 and the front surface of the upper recording material, $\mu 2$ is the frictional force between the rear surface of the upper recording material and the front surface of the lower recording material and $\mu 3$ is the frictional force between the rear surface of the lower recording material and the separation pad 4.

That is, When $\mu 1 \leqq \mu 2$, feeding of the recording material by the paper feed roller 3 does not occur. When $\mu 3 \leqq \mu 2$, separation of the one recording material from the other recording material does not occur.

When $\mu 1 \leqq \mu 3$ and if normal paper feed is conducted (if only a single recording material is fed by the paper feed roller 3), the frictional force between the separation pad and the paper exceeds that between the paper feed roller and the separation pad, and paper clogging thus occurs.

When a recording paper that has been cut in a direction from the recording surface toward the rear surface thereof is used in the above-mentioned type of recording apparatus, reduction in $\mu 1$ and increase in $\mu 3$ occur concurrently, and paper feed failure thus occurs without fail.

Therefore, when the recording paper is used in the recording apparatus, a recording paper obtained by cutting it from the rear surface thereof to the recording surface must be used.

In view of the aforementioned points, the recording apparatus must be constructed such that the separation means (separation pad) is disposed at a position where it makes contact with the surface of the recording material from which direction the recording material is cut, regardless of the recording or rear surface of the recording material. The direction from which the recording material is cut is used throughout the specification and claims to refer to the surface of the recording material against which the cutting blade first contacts.

Thus, the present invention provides a recording method which employs the recording material which is cut from the surface with which the separation means makes contact, and a recording apparatus in which the separation means is disposed such that it makes contact with the surface of the recording material which is opposite to the surface thereof toward which the recording material is cut. According to the present invention, occurrence of paper feed failures caused by feeding a large amount of recording material can be efficiently prevented.

Figure 2A:
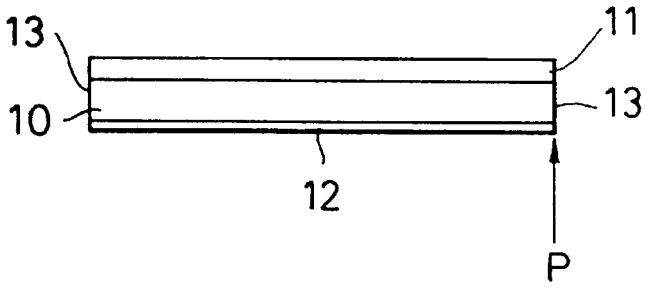
Figure 2B:
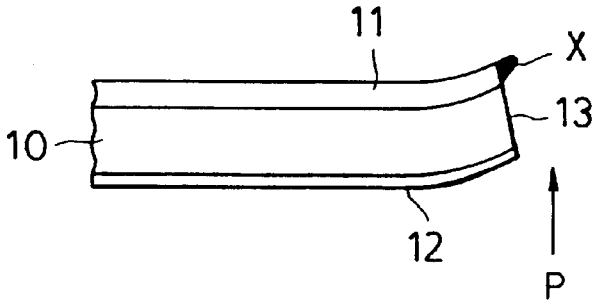

FIG. 2(*a*) is a schematic view showing the cross-section of a recording material having a coated layer formed thereon which is used in the present invention.

In general, a substrate 10 is made of paper or a plastic film.

Wood-free paper or paper containing wood pulp can be used as the paper of substrate 10. When necessary, glass or plastic fiber can be added to the paper. An inorganic filler, such as calcium carbonate, clay or china clay, a sizing agent or other paper making assistants can also be added to the paper. The paper is prepared by the conventional procedures. A paper having a thickness 50 to 200 $\mu$m conforming to JIS-P-8118 and a stiffness of 20 to 300 $cm^2/100$ (in the direction in which the paper is made) conforming to JIS-P-8143 is desired.

The coated layer 11 is provided on the recording surface of the substrate 10. The desired amount of coating of a coated layer 11 is from 1 to 50 $g/cm^2$. The main components of the coated layer 11 are a porous inorganic pigment which adsorbs the coating contained in the ink well and a resin serving as a binder.

Suitable examples of the pigment are fine silica powder, calcium carbonate, clay, china clay, diatomaceous earth, alumina, aluminium hydroxide, magnesium oxide, magnesium carbonate, titanium oxide, calcium silicate, magnesium silicate and aluminum silicate.

Suitable examples of the binder are emulsions of water-soluble resins, such as starch, polyvinyl alcohol, carboxymethylcellulose, hydroxyethyl cellullse, casein, gelatin and polyvinyl pyrrolidone, and emulsions of latex, acrylic and vinyl acetate polymers, such as styrene-butadience copolymer and methyl methacrylate-butadiene copolymer.

If necessary, a back coated layer 12 is provided on the rear surface of the substrate 10 to prevent curling.

The recording material is one which is cut at each of cutting portions 13 thereof from the rear surface to the recording surface (in the direction indicated by an arrow P in FIG. 2(*a*). As shown in FIG. 2(*b*), by cutting in the direction P, a burr or paper nap X is formed on the side of the coated surface, and the end portion of the recording material is curved toward the coated surface.

The cutting direction at the four edges of the recording material can be confirmed by observing the cutting surface using an optical microscope, i.e., by checking the edge on which burr or nap is generated or by checking the direction in which the end portion is curved. Also, the direction in which the vicinity of the cutting portion is bent can be checked by measuring the shape of the coated or rear surface using a surface roughness tester which adopts the tracer method.

EXAMPLE

A recording material was prepared in the manner described below: a substrate paper having a thickness of 90 μm was first prepared as the substrate by the conventional procedure using a Fortlinear paper machine. Next, a coated liquid, mainly made of synthetic silica (syloid 620, manufactured by Fuji Devison) and polyvinyl alcohol (PVA-117, manufactured by Kuraray), was coated on the substrate paper at a dry coat weight of 10 g/m$^2$ using an air knife coater. The obtained coated paper was dried by the conventional procedure, and was then subjected to the supercalender process.

Recording materials A of A4 size of this example were cut by bringing the blade of a guillotine cutter into contact with the rear surface of the coated paper and then by cutting the obtained coated paper in the direction P shown in FIG. 2(*a*) from the rear surface thereof to the recording surface thereof.

Recording materials B of A4 size of a comparative example were cut by bringing the blade of the guillotine cutter into contact with the recording surface of the coated paper and then by cutting the obtained coated paper from the recording surface thereof to the rear surface thereof. The cut edge of the two types of recording materials were observed using the optical microscope and by touching it with the finger. The end portion of the recording material A was bent toward the coated surface, and a burr was generated on the coated surface thereof. The end portion of the recording material B was bent toward the rear surface thereof, and a burr was generated on the rear surface thereof.

Recording was performed using the recording materials A and B and the ink jet recording apparatus shown in FIG. 1, wherein, for example, an ink jet recording head discharges ink by application of heat energy to the ink.

Recording could be performed on 5000 sheets of recording material A without any paper feed failure. Paper clogging occurred often and paper feeding was disabled when the number of recording materials B on which recording was performed reached about 1800.

While the present invention has been described with respect to what is presently considered to be the preferred embodiments, it is to be understood that the invention is not limited to the disclosed embodiments. The present invention is intended to cover various modifications and equivalent arrangements included within the spirit and scope of the appended claims.

What is claimed is:

1. A method for feeding to a recording apparatus, recording materials which have been cut in the direction from a non-recording surface toward an opposite recording surface thereof, and for reducing the wear on a separation member separating the recording materials and thereby reducing the incidence of recording material feed failures, the recording surface being a coated surface layer containing a pigment on a substrate, wherein the recording surface has microscopically observable burrs on the recording surface due to the cutting of the recording materials in the direction from the non-recording surface toward the recording surface, wherein an edge of the recording surface which has been cut has a microscopically observable curve toward the recording surface due to the cutting of the recording materials in the direction from the non-recording surface toward the recording surface, said method comprising the steps of:

stacking the recording materials so that each is oriented with (i) the burrs on the recording surface facing upward by facing the recording surface upward so the burrs are spaced away from a separation member when the separation member separates one of the recording materials from the other recording materials in the stack, and (ii) the microscopically observable curve of the cut edge thereof curving upward away from the separation member; and feeding one of the recording materials in the stack to a separation member and bringing a non-recording surface of the recording material of the stack into contact with the separation member to separate the recording material from other recording materials in the stack, thereby reducing wear of the separation member and reducing the incidence of recording material feed failures by spacing the burrs on the recording surface from the separation member during separation and preventing the separation member from receiving recording material whose cut edge microscopically curves toward the separation member.

2. The method according to claim 1, further comprising the step of feeding the separated recording material to said recording apparatus, and wherein said recording apparatus is an ink jet recording unit.

3. The method according to claim 2, wherein said ink jet recording unit discharges ink onto said separated recording material by application of heat energy to the ink.

4. The method according to claim 1, wherein said recording material has a stiffness of 20 to 300 cm$^2$/100 pursuant to JIS P 8143.

5. A recording system for recording on and feeding recording materials which have been cut in the direction from a non-recording surface toward an opposite recording surface thereof, and for reducing the wear on separation means separating the recording materials and thereby reducing the incidence of recording material feed failures, the recording surface being a coated surface layer containing a pigment on a substrate, wherein the recording surface has microscopically observable burrs on the recording surface due to the cutting of the recording materials in the direction from the non-recording surface toward the recording surface, wherein an edge of the recording surface which has been cut has a microscopically observable curve toward the recording surface due to the cutting of the recording materials in the direction from the non-recording surface toward the recording surface, said system comprising:

a stack of recording materials, each recording material in said stack of recording materials being oriented with (i) the burrs on the recording surface facing upward by facing the recording surface upward so the burrs are spaced away from separation means when the separation means separates one of the recording materials from the other recording materials in said stack, and (ii) the microscopically observable curve of the cut edge curving upward away from the separation means;

a tray containing said stack of recording materials;

separation means for separating, one by one, recording materials from said stack of recording materials in the tray;

means for feeding recording materials from said stack of recording materials, one by one, to a recording position, said feeding means bringing the non-recording surface of the recording material into contact with said separation means during feeding thereof to separate the recording material from other recording materials, thereby reducing wear of said separation means and reducing the incidence of recording material feed failures by spacing the burrs on the recording surface from said separation means during separation and preventing said separation means from receiving recording material whose cut edge microscopically curves toward said separation means; and a recording head for recording on the separated recording material which has been fed to said recording position by said feeding means.

6. The recording apparatus according to claim 5, wherein said recording head comprises an ink jet recording head.

7. The recording apparatus according to claim 5, wherein said recording head comprises an ink jet recording head discharges ink onto the separated recording material by application of heat energy to the ink.

8. The recording apparatus according to claim 5, wherein said recording material has a stiffness of 20 to 300 $cm^2/100$ pursuant to JIS P 8143.

9. A method for recording on and feeding recording materials which have been cut in the direction from a non-recording surface toward an opposite recording surface thereof, and for reducing the wear on separation means separating the recording materials and reducing the incidence of recording material feed failures, the recording surface being a coated surface layer containing a pigment on a substrate, wherein the recording surface has microscopically observable burrs on the recording surface due to the cutting of the recording materials in the direction from the non-recording surface toward the recording surface, wherein an edge of the recording surface which has been cut has a microscopically observable curve toward the recording surface due to the cutting of the recording materials in the direction from the non-recording surface toward the recording surface, said method comprising the steps of:

stacking the recording materials, so that each recording material in the stack of recording materials is oriented with (i) the burrs on the recording surface facing upward by facing the recording surface upward so the burrs are spaced away from a separation member when the separation member separates one of the recording materials from the other recording materials in the stack, and (ii) the microscopically observable curve of the cut edge thereof curving upward away from the separation member;

feeding one recording material of the stack of recording materials to a separation member and bringing the non-recording surface of the fed recording material into contact with the separation member to separate the fed recording material from other recording materials in the stack, thereby reducing wear of the separation member and reducing the incidence of recording material feed failures by spacing the burrs on the recording surface from the separation member during separation and preventing the seperation member from receiving recording material whose cut edge microscopically curves toward the separation member; and recording by an ink-jet recording head on the separated recording material which has been fed to a recording position.

10. The method according to claim 6, wherein the step of recording by said ink-jet recording head includes the step of discharging ink droplets onto said recording material by application of heat energy to ink.

11. The method according to claim 9, wherein said recording material has a stiffness of 20 to 300 $cm^2/100$ pursuant to JIS P 8143.

12. A stack of recording materials for use with an ink-jet recording apparatus for recording on and feeding the recording materials from said stack which have been cut only in the direction from a non-recording surface toward an opposite recording surface thereof, and for reducing the wear on a separation member separating the recording materials thereby reducing the incidence of recording material feed failures by bringing the non-recording surface of the recording material into contact with the separation member, said stack of recording materials comprising:

a plurality of recording materials, arranged substantially surface to surface, each of said plurality of recording materials comprising:

a substrate;

a coated recording surface layer containing a pigment of the substrate, the coated surface layer being the recording surface; and a non-recording surface opposite from the recording surface, wherein the recording surface has microscopically observable burrs thereon due to the cutting of the recording materials only in the direction from the non-recording surface toward the recording surface, wherein an edge of the recording surface which has been cut has a microscopically observable curve toward the recording surface due to the cutting of the recording materials only in the direction from the non-recording surface toward the recording surface, whereby when the recording material is fed so that the separation member contacts the non-recording surface thereof, the burrs on the recording surface are spaced away from the separation member during separation and the separation member is prevented from receiving recording material whose cut edge microscopically curves toward the separation member, thereby reducing wear of the separation member and reducing the incidence of recording material feed failures.

13. The stack of recording materials according to claim 10, wherein each of said plurality of recording materials has a stiffness of 20 to 300 $cm^2/100$ pursuant to JIS P 8143.

14. A stack of recording materials comprising:

a plurality of recording materials, arranged substantially surface to surface, each of said plurality of recording materials comprising:

a substrate;

a coated recording surface layer containing a pigment on the substrate, the coated surface layer being the recording surface; and a non-recording surface opposite from the recording surface, wherein the recording surface has burrs, that are only observable microscopically, thereon due to the cutting of the recording materials only in the direction from the non-recording surface toward the recording surface.

* * * * *

UNITED STATES PATENT AND TRADEMARK OFFICE

CERTIFICATE OF CORRECTION

PATENT NO. : 6,055,001
DATED : April 25, 2000
INVENTOR(S) : Mamoru Sakaki, et al.

It is certified that error appears in the above-identified patent and that said Letters Patent is hereby corrected as shown below:

Column 2,
Line 61, "effect" should read -- affect --.

Column 7,
Line 13, "apparatus" should read -- system --;
Line 15, "apparatus" should read -- system --;
Line 16, "head" should read -- head which --; and
Line 63, "claim 6," should read -- claim 9, --.

Column 8,
Line 45, "10," should read -- 12, --.

Signed and Sealed this

Eleventh Day of September, 2001

*Attest:*

Nicholas P. Godici

NICHOLAS P. GODICI
*Acting Director of the United States Patent and Trademark Office*

*Attesting Officer*